US005329645A

United States Patent [19]

Fossum et al.

[11] Patent Number: 5,329,645

[45] Date of Patent: Jul. 19, 1994

[54] COMMODE COMFORT SUPPORT SYSTEM

[75] Inventors: Shirleen D. Fossum; Gary L. Monson, both of New Effington; Janel C. Rohde; Kenneth A. Rohde, both of Rosholt, all of S. Dak.

[73] Assignee: Rest Assured, Inc., Rosholt, S. Dak.

[21] Appl. No.: 2,676

[22] Filed: Jan. 11, 1993

Related U.S. Application Data

[63] Continuation of Ser. No. 650,862, Feb. 5, 1991, abandoned.

[51] Int. Cl.[5] ..... E03D 11/00

[52] U.S. Cl. ..... 4/254

[58] Field of Search ..... 4/254, 480, 573.1, 578.1; 108/48, 137

[56] References Cited

U.S. PATENT DOCUMENTS

| | | | |
|---|---|---|---|
| 597,878 | 1/1898 | Crandall | 4/480 X |
| 933,148 | 9/1909 | Wilson | 4/254 |
| 1,210,419 | 1/1917 | Cerney | 4/254 |
| 2,461,715 | 2/1949 | Biggerstaff | 108/137 |
| 2,773,542 | 12/1956 | Chasin . | |
| 3,090,051 | 5/1963 | Oakland | 4/254 |
| 3,245,090 | 4/1966 | Slimmer | 4/480 X |
| 3,398,410 | 8/1968 | Sparling | 4/254 |
| 4,196,480 | 4/1980 | Guenther et al. | 4/254 |
| 4,787,102 | 11/1988 | Rosenberg | 4/254 |
| 4,894,871 | 1/1990 | Schmerler . | |
| 4,924,531 | 5/1990 | Square . | |

FOREIGN PATENT DOCUMENTS

| | | | |
|---|---|---|---|
| 0571802 | 1/1958 | Italy | 4/254 |

*Primary Examiner*—Charles E. Phillips

*Attorney, Agent, or Firm*—Jacobson, Price, Holman & Stern

[57] ABSTRACT

A device for providing support for a user seated on a commode and comprising a substantially U-shaped framework attached to a wall behind the commode includes a pair of elongated horizontal members joined by a crossbar and having legs at its forward corners. The framework is rotated through substantially 90° to rest with its legs on the floor in front of the commode. A padded tray is slidably mounted on and rotatable with the horizontal members of the framework and is moved closely adjacent to the user when the user is seated on the commode. When not in use, the device is rotated upward, folded against the wall, and secured to the wall by a clip. The device is preferably made of polyvinyl chloride pipe and the tray is covered with a sheet of plastic material.

2 Claims, 3 Drawing Sheets

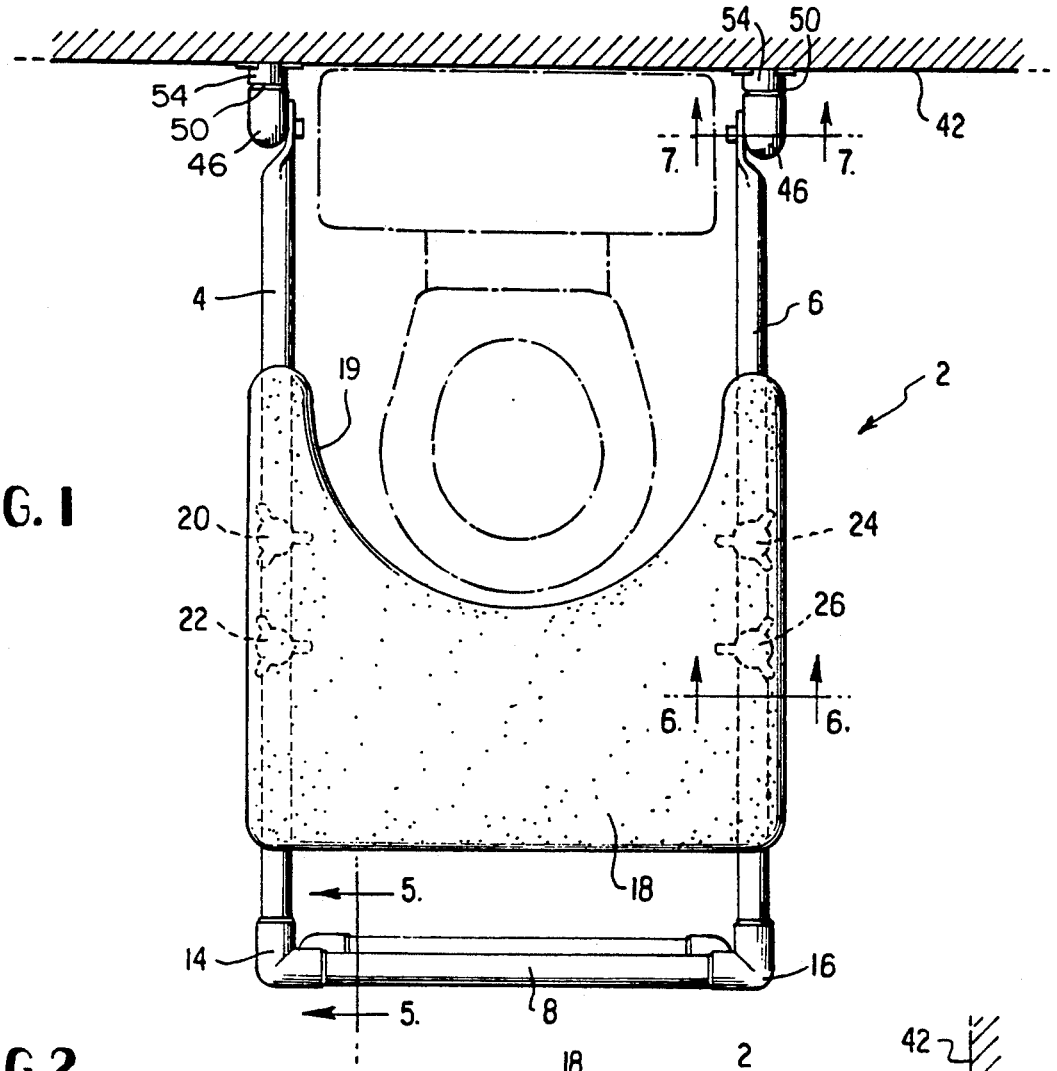
FIG. 1
FIG. 2
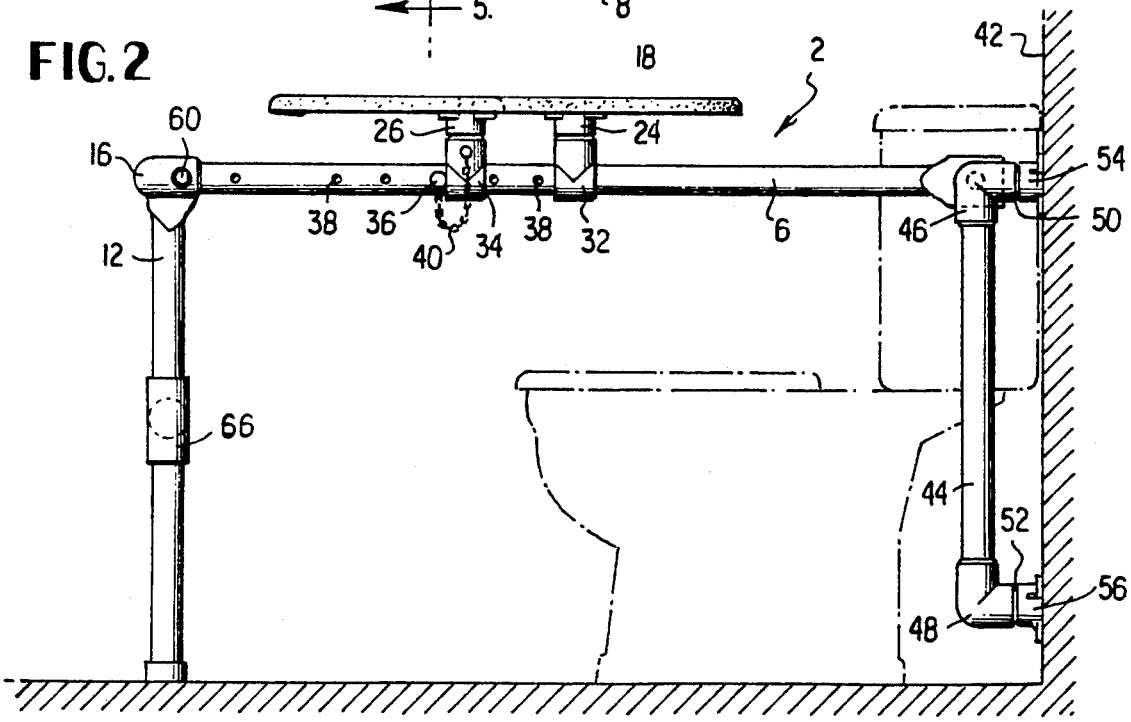

COMMODE COMFORT SUPPORT SYSTEM

This is a continuation of application Ser. No. 07/650,862, filed Feb. 5, 1991 now abandoned.

FIELD OF THE INVENTION

The invention relates to devices for supporting a patient while using a commode.

BACKGROUND OF THE INVENTION

Support devices for elderly or handicapped persons while using a commode generally do not allow the patient as much independence and privacy as is desirable. The patent to Chasin, U.S. Pat. No. 2,773,542, describes a support device for physically handicapped persons which is fastened to the back of a commode. The device provides arm rests and/or hand grips for a user, but no support in front of the user is provided. Guenther et al., U.S. Pat. No. 4,196,480, also describes a device which provides arm rests and/or hand grips for an invalid using a commode. A support in front of the patient is not provided. The device is fastened to the commode and is folded upward for storage. Oakland, U.S. Pat. No. 3,090,051, provides a support in front of the patient. The device may be floor mounted, commode mounted or wall mounted, and may be folded when not in use. A table or board in front of the patient must be removed for ingress and egress of the patient.

Schmerler, U.S. Pat. No. 4,894,871, describes a framework for enabling a patient to move from a seated to a standing position. U.S. Pat. No. 4,924,531 to Square describes another device which provides hand grips for an invalid commode user. The device is spring loaded to provide resilient assistance to the patient.

SUMMARY OF THE INVENTION

Invalids, elderly, handicapped or infirm people often need assistance in reaching the commode and in leaving it after use. The system of the invention allows the user to be helped to and from the commode and, after an attendant has positioned the system in front of the user, the attendant may leave the user in privacy, in a safe, comfortable position, returning when summoned.

The system provides comfort, support and reassurance to an infirm user seated on the commode. The system includes a framework pivotally attached to members secured to a wall behind the commode. The framework is rotated through 90° to rest with its forward legs on the floor in front of the commode. A padded tray is slidably mounted on horizontal members of the framework and is moved adjacent to the user when the user is seated on the commode. When not in use, the device is rotated upward, folded against the wall, and secured to the wall by a clip. The device is preferably made of polyvinyl chloride pipe and the tray is covered with a sheet of plastic material.

It is an object of the invention to provide a commode comfort support system for supporting a user seated on a commode.

BRIEF DESCRIPTION OF THE DRAWINGS

FIG. 1 is a top plan view of a commode comfort support system of the invention.

FIG. 2 is a side elevational view of the system of FIG. 1.

DETAILED DESCRIPTION OF THE INVENTION

Figure 4:
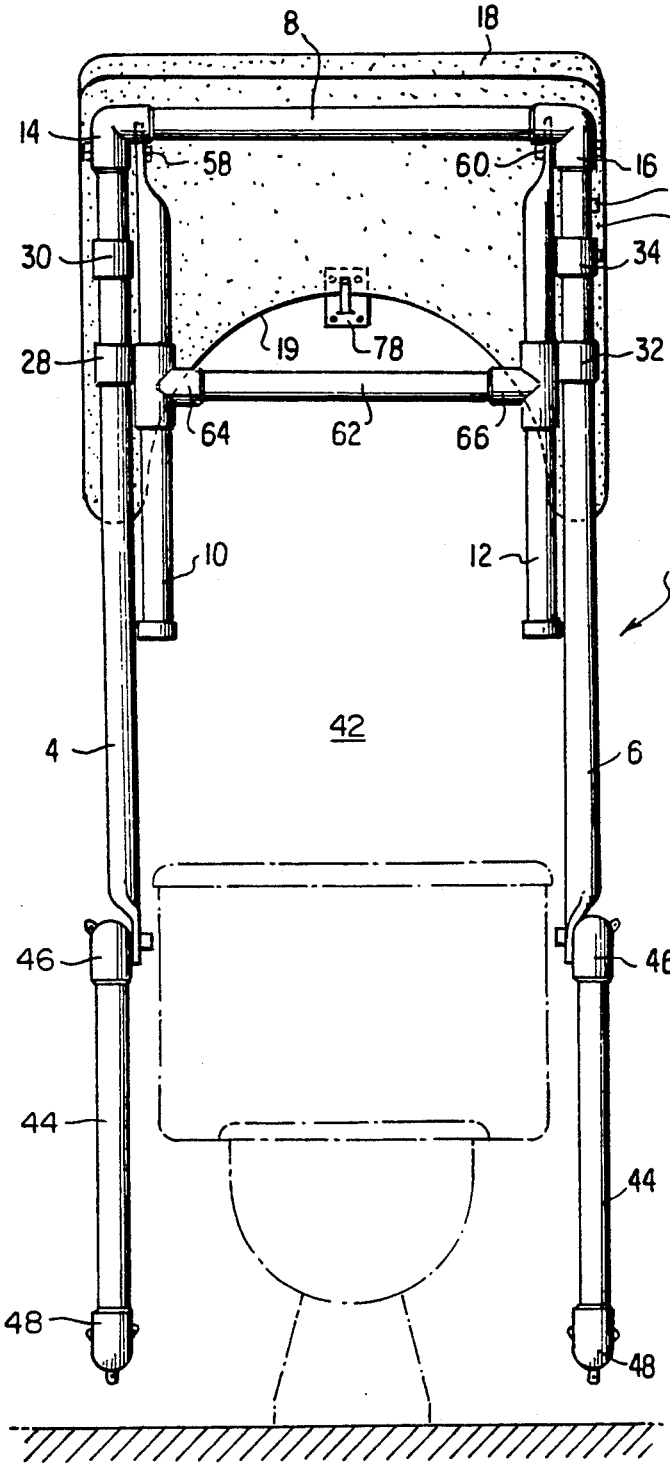
FIG. 4 is a side elevational view of the system of FIG. 4.

Hospital or nursing home patients and handicapped, elderly or otherwise infirm people may need assistance while using a commode. The commode comfort support system of the invention allows such users to have independence and privacy.

The system is wall mounted and folds upwardly against the wall behind the commode, when not in use. The user is assisted to the commode and the system is folded downward over the user with the front legs extended to rest on the floor and the tray then is positioned comfortably around and in front of the seated user, so that the user may rest his or her arms on the tray, in a natural posture. The user can then be safely left alone, without fear of falling. The device is made of materials which are easily cleaned.

With reference to the Figures, in which like numerals represent like parts, commode comfort support system 2 is shown in FIGS. 1 to 7. System 2 includes a framework having side horizontal members 4, 6 connected by front horizontal crossbar 8. Members 4 and 6 and crossbar 8 form a U-shaped framework which is substantially coplanar. Front legs 10, 12, which may have rubber or plastic pads on the lower surfaces which rest on the floor, support front corner elbow members 14, 16 which connect a forward end of each of the side horizontal members 4, 6 with an end of crossbar 8.

FIGS. 1 and 2 illustrate system 2 in place around a commode, shown in phantom. Tray 18 is adjustably supported on side horizontal members 4, 6. Supports 20, 22, 24 and 26 are screwed, or otherwise fastened, to the underside of tray 18. Slidable guide members 28, 30, 32 and 34 are positioned around side members 4 and 6, respectively, supporting tray 18. As is clearly shown in FIGS. 1 and 2, tray 18 may be moved from a forward position toward the user into a rearward position so that the tray is positioned comfortably with its curved edge 19 adjacent the user, providing support to a user seated on the commode who may wish to rest on, hold onto or lean on the tray. As is further clearly shown in FIG. 2, tray 18 is secured in the desired rearward position by insertion of pin 36 in one of a plurality of holes 38 in the horizontal side member 6. Pin 36 is attached to slidable guide member 34 by chain 40.

System 2 is attached to a vertical wall 42 behind the commode. A suitable support (one on each side of the system 2) includes vertical member 44 joined by elbow members 46, 48 to horizontal members 50, 52 which are, in turn, connected to support brackets 54, 56, attached to the wall.

Figure 3:
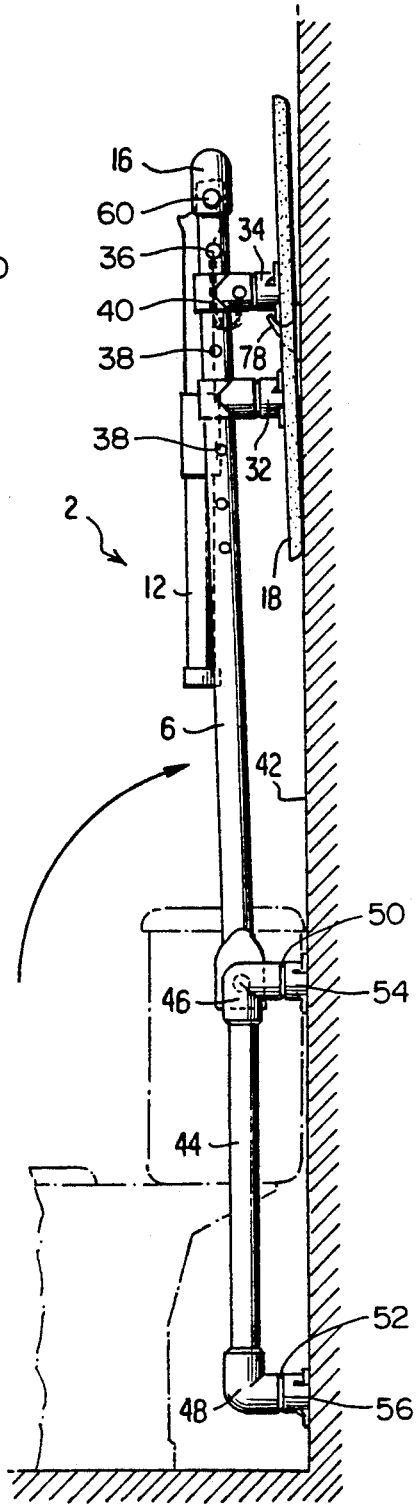
FIG. 3 is a front view of the system of FIG. 1 in upwardly folded position.

FIGS. 3 and 4 show system 2 in upwardly folded position. Front legs 10, 12 are hinged to front elbow members 14, 16 by bolts 58, 60 which act as pivot pins. Front legs 10, 12 are strengthened by horizontal crossbar 62 connecting front legs 10, 12 at T-joints 64, 66.

Figure 5:
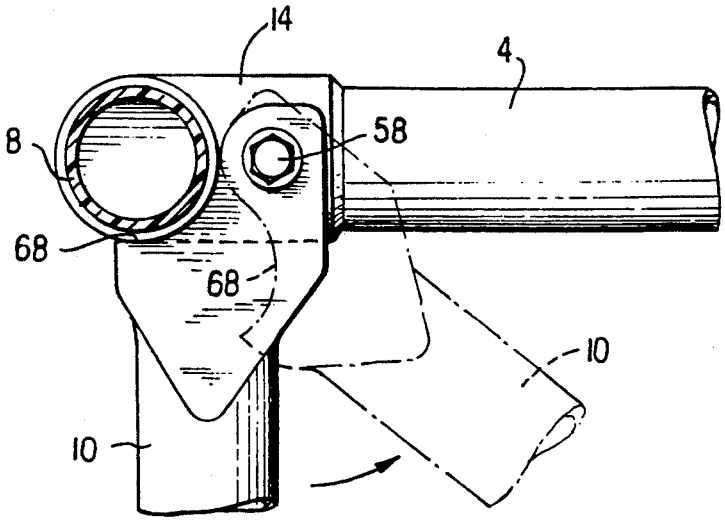
FIG. 5 is a cross-sectional view taken on line 5—5 of FIG. 1.

FIG. 5 shows a detail of a joint between a front elbow member and a front leg. Horizontal members 4 and 8 are connected together by elbow member 14. Front leg 10 is pivoted about bolt 58 for folding. When front leg 10 is in vertical position, curved upper edge 68 of leg 10 supports elbow member 14 and front horizontal member 8. Elbow member 14 acts as a stop for curved surface 68 when front leg member 10 is perpendicular to front horizontal member 8, i.e. when front leg member 10 is in position, vertically, supporting the associated front corner of the system 2.

Figure 6:
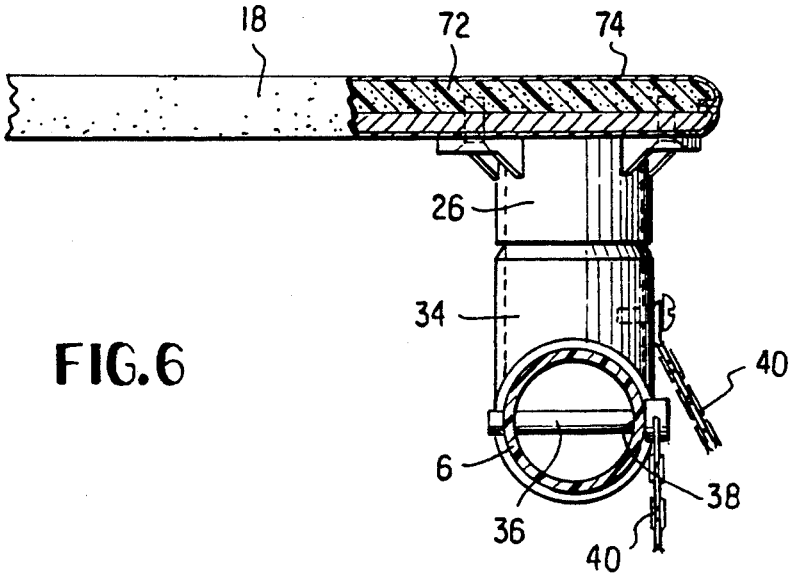
FIG. 6 is a cross-sectional view taken on line 6—6 of FIG. 1.

FIG. 6 illustrates a detail of tray 18 and its support. Tray 18 is typically manufactured with a rigid base 70 covered by a plastic foam pad 72. Base 70 may be of wood. The tray has an outer covering of washable sheet plastic 74 which may be laminated to a fabric backing, as known in the art. Plastic covering 74 is easily washable. Tray 18 is secured to support 26 which is attached to slidable guide member 34 which passes around horizontal member 6. Tray 18 is positioned where required and pin 36, attached to chain 40 is inserted through hole 38 in horizontal member 6. A similar joint connects tray 18 to member 4, on the opposite side of the device.

Figure 7:
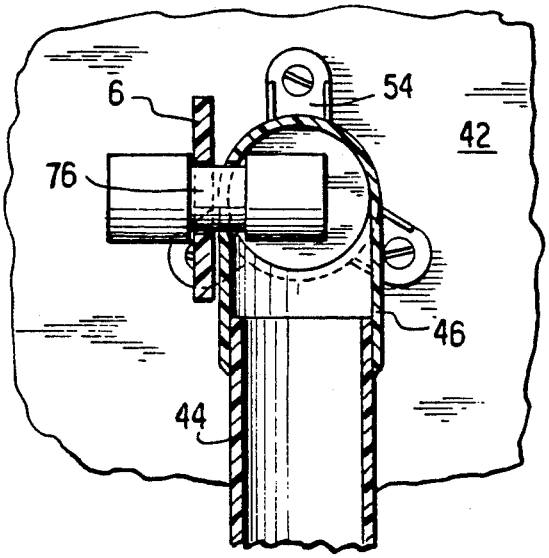
FIG. 7 is a cross-section view taken on line 7—7 of FIG. 1.

FIG. 7 illustrates a detail of the joint connecting system 2 to wall 42. Vertical member 44 is engaged with elbow member 46 which is secured to wall 42 by support 54. Horizontal member 6 is connected to elbow joint 46 by pivot 76. In use, when system 2 is folded against wall 42, member 6 rotates about pivot 76.

When the system is stored against the wall, the tray is pulled to its most forward position and the system folded upward. Tray 18 is then moved downward to be supported by clip 78, shown in FIG. 3, which is attached to the wall. Thus, system 2 is fastened securely against wall 42. In this position, legs 10, 12 store neatly inside horizontal members 4, 6 against wall 42.

The unit may be constructed of material known in the art. Preferred materials are white, seamless, furniture-grade 1¼ inch PVC pipe. Other sizes may be used. The precisely cut and assembled pieces are fixed with a PVC bonding agent to provide a strong framework which is virtually indestructible in its intended use. All PVC pipe surfaces, joints and fittings are smooth and contain no rough or sharp edges or similar projections on which a user could become injured. Likewise, the tray has smooth, rounded contours with no protrusions or sharp corners. A suitable covering for the tray is commercial grade imitation leather over a ½ inch thickness of foam padding, constructed with sewn and reversed seams. The covering is closed with an overlapping velcro closure along its leading edge, in an inconspicuous position such as on the front underside of the tray, away from the seated user, as is known in the art.

In use, the attendant releases tray 18 from hook 78 by sliding tray 18 slightly upward, and then lowers the unit slowly in a 90° arc until it comes to rest on the extended front legs on the floor, on either side of a seated user, without the tray striking the user. Tray 18 then is moved rearward to a comfortable position close to the user and retaining pin 36 is inserted in a convenient hole 38 provided along the side of horizontal bar 6. Once the chained pin is in place, the nursing attendant is free to leave the room, confident that the user is safely and securely seated and at ease on the commode. Since most hospitals and nursing home facilities are now equipped with "attendant call" buttons, the user can activate the "attendant call" to summon assistance when ready to be assisted from the commode. The unit is easily and quickly restored to its upright position against the wall and the user is accompanied from the bathroom.

Any appropriate dimensions may be used. In a non-limiting example, a unit extends 48 inches horizontally from the wall to the outer edge of the framework. The framework is 27 inches wide across the top surface of the tray and 28 inches from the top of the tray to the floor. The unit is mounted on the wall surface so that the underside of the lower mounting bracket is about 2 to 4 inches from the floor.

All surfaces of the unit are easily wiped clean with a damp cloth, and are virtually maintenance-free. When the unit is folded against the wall, no part of the unit touches the floor, leaving the floor clear for washing and leaving the commode unimpeded for cleaning.

While the invention has been described above with respect to certain embodiments thereof, variations and modifications may be made without departing from the spirit and scope of the invention.

What is claimed is:

1. A device for providing support for a user seated on a commode, which commode is positioned adjacent an intersection of a wall and a floor, said device comprising;

a substantially U-shaped framework, wherein said framework comprises first and second elongated members having rearward ends adapted to be pivotably attached to the wall behind the commode, one on each side of the commode, and forward ends joined to an elongated forward crossbar which extends between the forward ends in front of the commode when a forward end of the framework is supported on the floor, said first and second elongated members and said crossbar being substantially coplanar;

floor-engaging means hinged to said framework for supporting the forward end of said framework on the floor, said floor-engaging means being pivotable between a position extending essentially parallel to said framework and a floor-engaging position extending essentially perpendicular to said framework;

means for limiting pivotable movement of said floor-engaging means into its floor-engaging position;

means for pivotably attaching said rearward ends of said first and second elongated members of said framework to the wall and permitting pivoting of said wall-attached framework through at least 90°;

a tray slidably mounted on said framework for movement between a forward position and a rearward user-supporting position on said framework; and means for releasably securing said tray in a selected one of a plurality of positions on said framework;

said first and second elongated members being of such a length that when said tray is in its forward-most position on said framework and the user is seated on the commode, said framework and tray are pivotable through said at least 90° between a storage position resting adjacent the wall and a use position in which said framework is supported on the floor by said hinged floor-engaging means with said tray and said framework forward crossbar passing over the user seated on the commode, and wherein, when said framework is supported on the floor, said tray can be selectively moved between its forward position and its rearward user-supporting position on said framework closely adjacent the user seated on the commode.

2. A device as recited in claim 1, wherein said tray is of padded construction and comprises a curved rearward edge.

* * * * *